US007980212B2

(12) United States Patent
Roh

(10) Patent No.: US 7,980,212 B2
(45) Date of Patent: Jul. 19, 2011

(54) VARIABLE VALVE LIFT APPARATUS

(75) Inventor: Tae Hoon Roh, Seoul (KR)

(73) Assignee: Hyundai Motor Company, Seoul (KR)

( * ) Notice: Subject to any disclaimer, the term of this patent is extended or adjusted under 35 U.S.C. 154(b) by 316 days.

(21) Appl. No.: 12/275,053

(22) Filed: Nov. 20, 2008

(65) Prior Publication Data

US 2009/0266323 A1 Oct. 29, 2009

(30) Foreign Application Priority Data

Apr. 29, 2008 (KR) ..... 10-2008-0040040

(51) Int. Cl.
*F01L 1/34* (2006.01)

(52) U.S. Cl. ..... 123/90.16; 123/90.39

(58) Field of Classification Search ..... 123/90.15, 123/90.16, 90.17, 90.31, 90.39; 74/559
See application file for complete search history.

(56) References Cited

U.S. PATENT DOCUMENTS 6,622,678 B2 * 9/2003 Shimizu et al. ..... 123/90.16
2003/0094155 A1 * 5/2003 Shimoyama et al. ..... 123/188.2

FOREIGN PATENT DOCUMENTS

JP 2006-70739 A 3/2006

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include a cam that is disposed to a camshaft and rotates, a rocker arm that is disposed to the camshaft and in which a relative rotation angle of the rocker arm around the camshaft is variable, a cam follower that contacts the cam, receives rotation of the cam, and pivots around the rocker arm, and a swing arm that contacts the cam follower and drives a valve.

9 Claims, 12 Drawing Sheets

VARIABLE VALVE LIFT APPARATUS

CROSS-REFERENCE TO RELATED APPLICATION

The present application claims priority to Korean Patent Application No. 10-2008-0040040 filed Apr. 29, 2008, the entire contents of which application is incorporated herein for all purposes by this reference.

BACKGROUND OF THE INVENTION

1. Field of the Invention

The present invention relates to a continuous variable valve lift apparatus, and more particularly to a continuous variable valve lift apparatus that can adjust a valve lift amount in response to an operational state of an engine.

2. Description of Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables variable valve lifts depending on the engine speed.

For such a VVL apparatus, it is recommended that power loss in driving the valves using torque of the camshaft is minimized. In addition, it is recommended that the VVL apparatus is symmetrically designed such that it may be symmetrically installed in both banks in a V-engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift (VVL) apparatus having various advantages such as minimized friction and power loss with simple structure and enhanced controllability and ease of assembly.

In an aspect of the present invention, a variable valve lift apparatus may include a cam that is co-axially attached to a camshaft and rotates by the camshaft, a rocker arm, one end of which is rotatably coupled to the camshaft, wherein a relative rotation angle of the rocker arm around the camshaft is variable by an actuator, a cam follower, one end of which is pivotally coupled to the other end of the rocker arm, wherein a contact portion of the cam follower contacts the cam and receives rotational movement of the cam, and/or a swing arm that contacts the other end of the cam follower and drives a valve coupled to one end of the swing arm according to rotation of the cam.

A first roller may be disposed to the contact portion of the cam follower and contacts the cam.

A second roller may be disposed to the other end of the cam follower and rotatably contacts the swing arm. The swing arm may have a predetermined curvature along a longitudinal direction thereof to receive the second roller of the cam follower.

The other end of the rocker arm and the one end of the cam follower may be coupled by a connecting shaft and the cam follower pivots around the connecting shaft according to rotation of the rocker arm.

A rotation center of the swing arm may be a portion that the other end of the swing arm and a hydraulic lash adjuster ("HLA") are coupled each other.

The actuator may be electrically connected with a control unit that controls the relative rotation angle of the rocker arm around the camshaft.

The actuator may comprise a DC motor. The actuator may comprise a worm gear connected with the DC motor and a worm wheel attached to the one end of the rocker arm, wherein the worm gear and the worm wheel are engaged each other.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
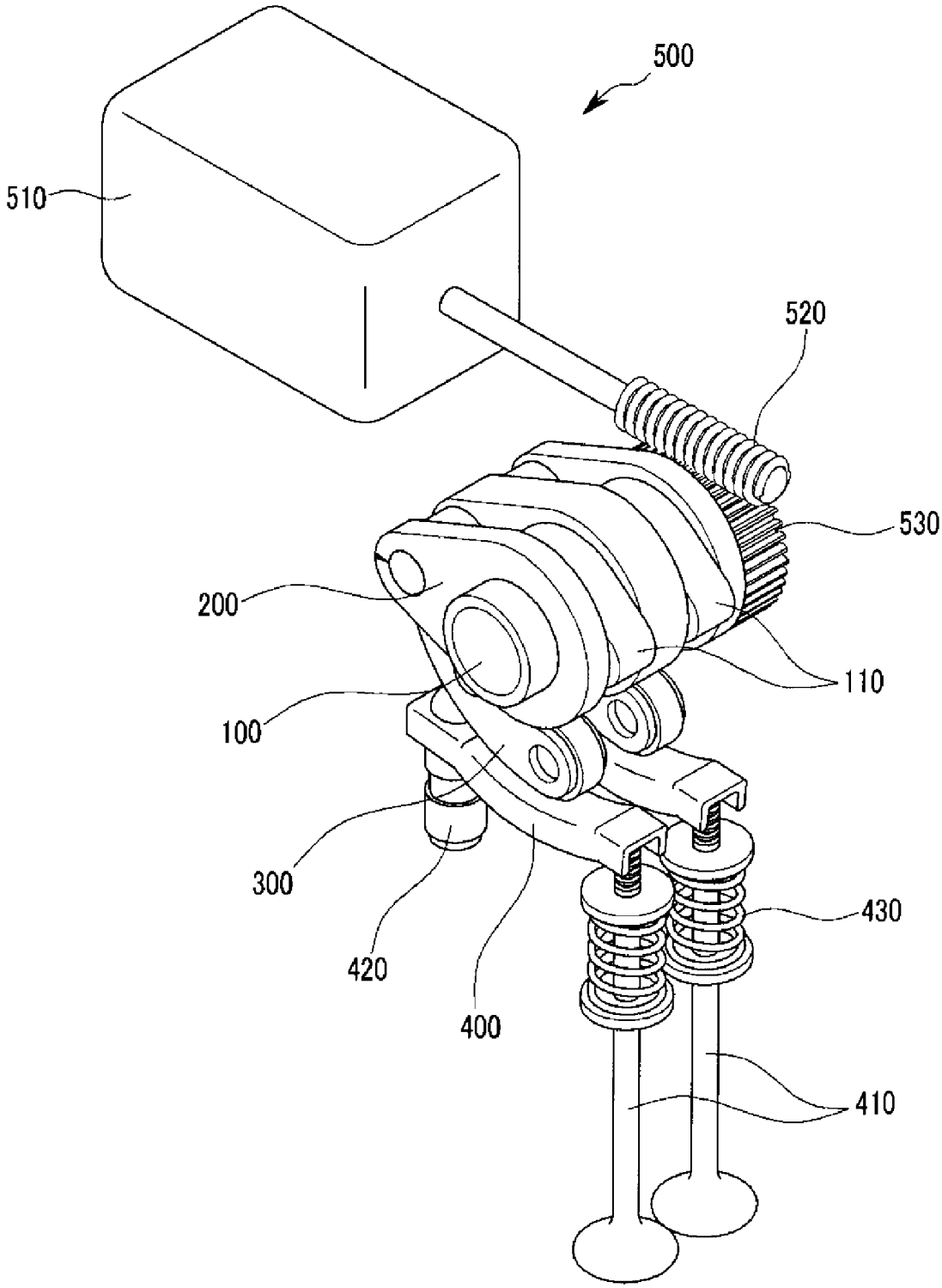
FIG. 1 is perspective view of an exemplary variable valve lift apparatus according to the present invention.
Figure 2:
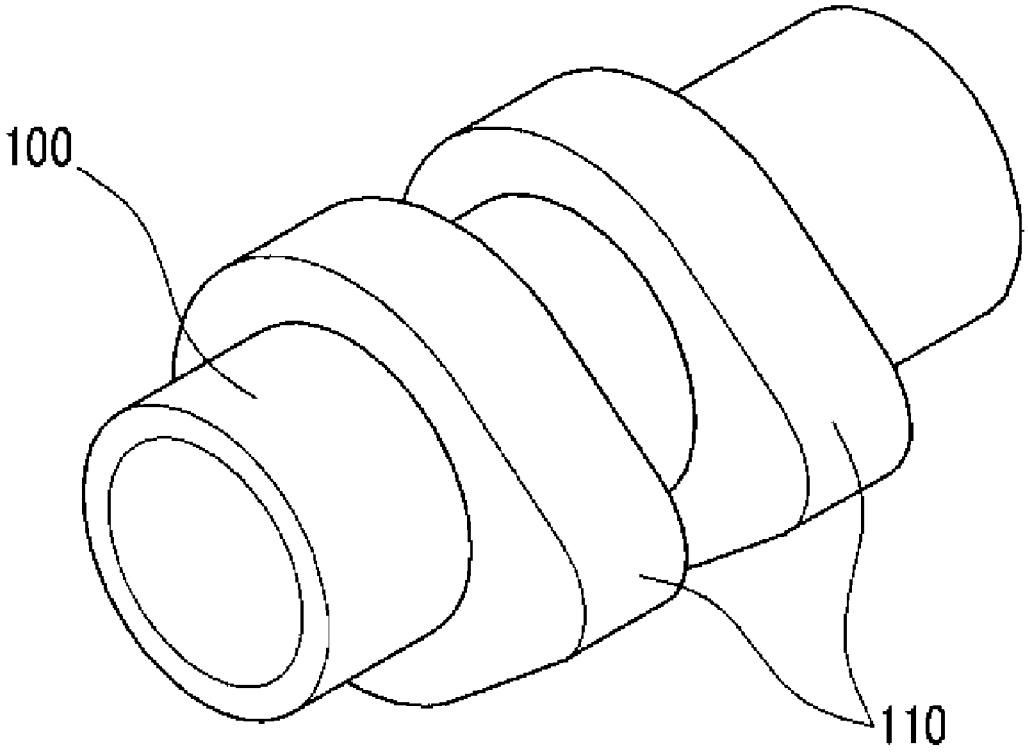
FIG. 2 is drawing showing a cam and a camshaft of an exemplary variable valve lift apparatus according to the present invention.
Figure 3:
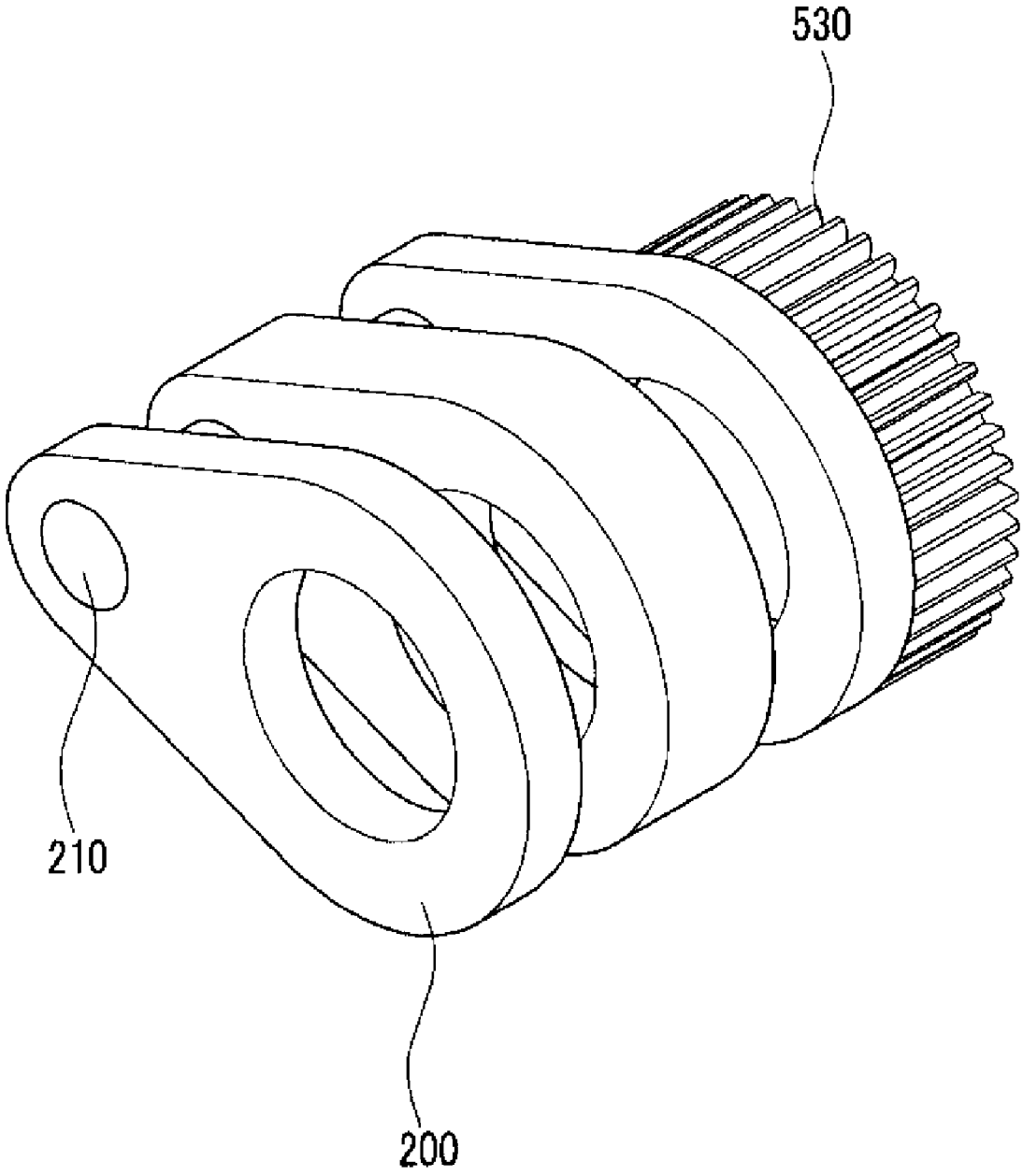
FIG. 3 is drawing showing a rocker arm of an exemplary variable valve lift apparatus according to the present invention.
Figure 4:
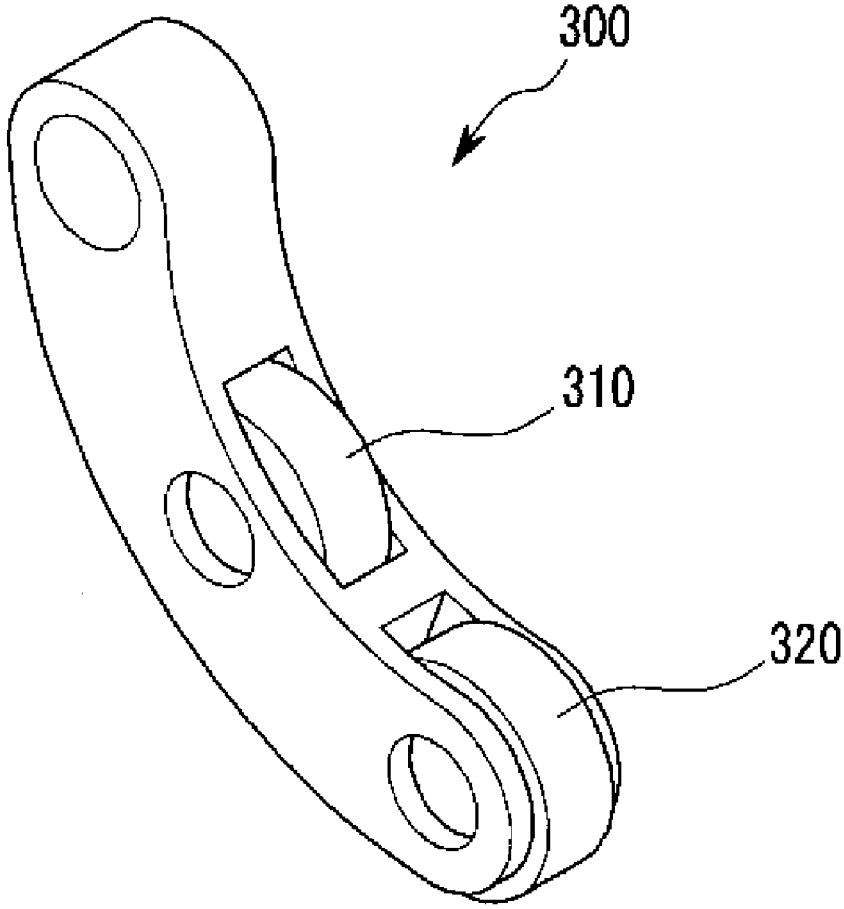
FIG. 4 is drawing showing a cam follower of an exemplary variable valve lift apparatus according to the present invention.
Figure 5:
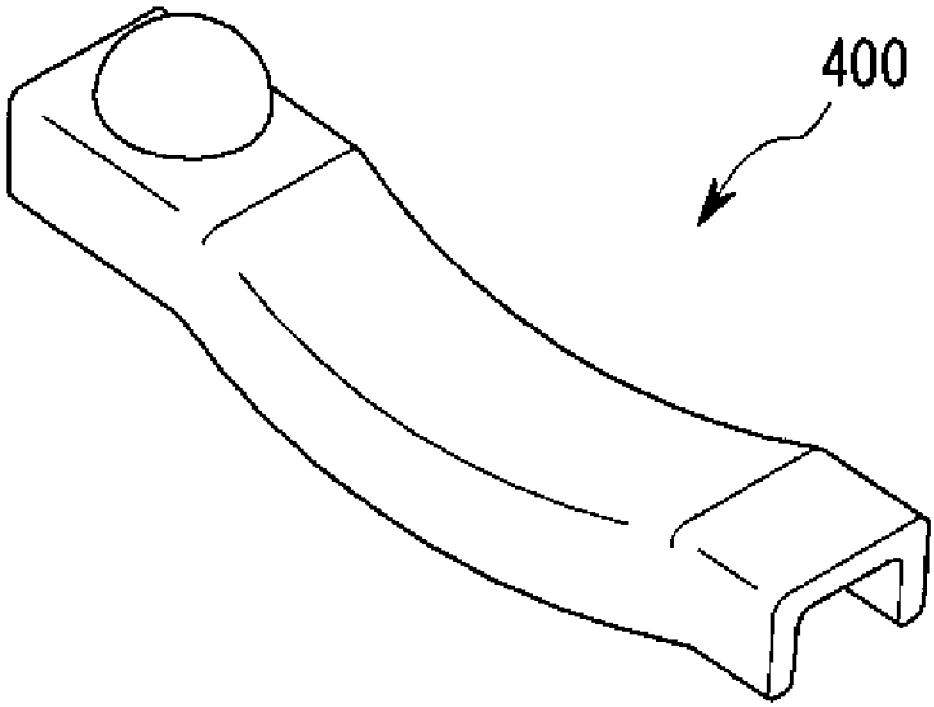
FIG. 5 is drawing showing a swing arm of an exemplary variable valve lift apparatus according to the present invention.
Figure 6:
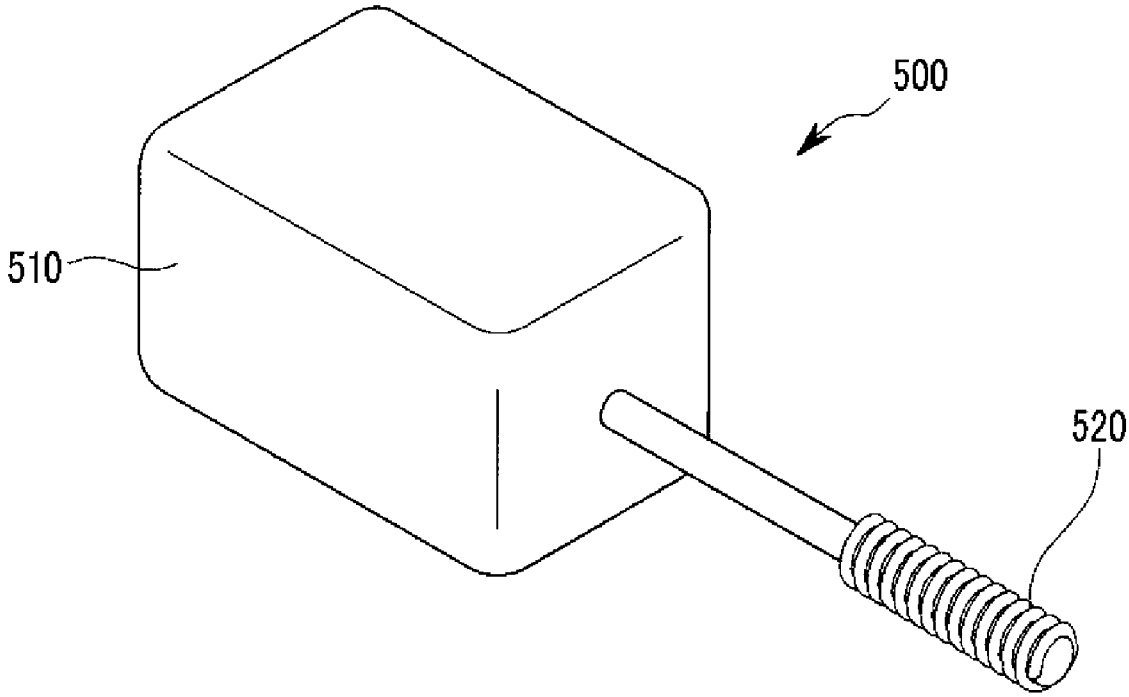
FIG. 6 is drawing showing a control unit of an exemplary variable valve lift apparatus according to the present invention.

FIG. 1 is perspective view of an exemplary variable valve lift apparatus according to various embodiments of the present invention.

In FIG. 2 to FIG. 6, elements of a variable valve lift apparatus are shown.

Referring to FIG. 1 to FIG. 6, a variable valve lift apparatus according various embodiments of the present invention includes a cam 110 that is operably attached to a camshaft 100 and a rocker arm 200, one end of which is rotatably coupled to the camshaft 100, wherein a relative rotation angle of the rocker arm 200 around the camshaft 10 is variable. Also, the variable valve lift apparatus further includes a cam follower 300, one end of which is coupled to the other end of the rocker arm 200, receives rotation movement of the cam 110 by contacting the cam 110, and pivots around the rocker arm 200, and a swing arm 400 that contacts the cam follower 300 and drives a valve 410 according to rotation of the cam 110.

An end of the swing arm 400 is supported by a hydraulic lash adjuster (HLA) 420, and the other end of the swing arm 400 is provided to the valve 410. The end of the swing arm 300 is a rotation center of the swing arm 300 as explained later.

A first roller 310 and a second roller 320 are disposed to the cam follower 300, and the first roller 310 contacts the cam 110 and the second roller 320 coupled to the other end of the cam follower 300 contacts the swing arm 400.

Friction between the cam 110 and the cam follower 300 and between the cam follower 300 and the swing arm 400 may thereby be minimized.

A connecting shaft 210 is disposed to the rocker arm 200 to couple the other end of the rocker arm 200 and the end of the cam follower 300, and the cam follower 300 pivots around the connecting shaft 210.

The rocker arm 200 is connected with a control unit 500 that controls the relative rotation angle of the rocker arm 200 around the camshaft 100.

The control unit 500 may include a DC motor 510, or different types of driving elements may be used, and herein the DC motor 510 controls the relative rotation angle of the rocker arm 200 around the camshaft 10.

The control unit 500 may include a worm gear 520 connected with the DC motor 510 and a worm wheel 530 connected with the rocker arm 200 so that precise controlling of the relative rotation angle of the rocker arm 200 around the camshaft 10 can be achieved.

Figure 7:
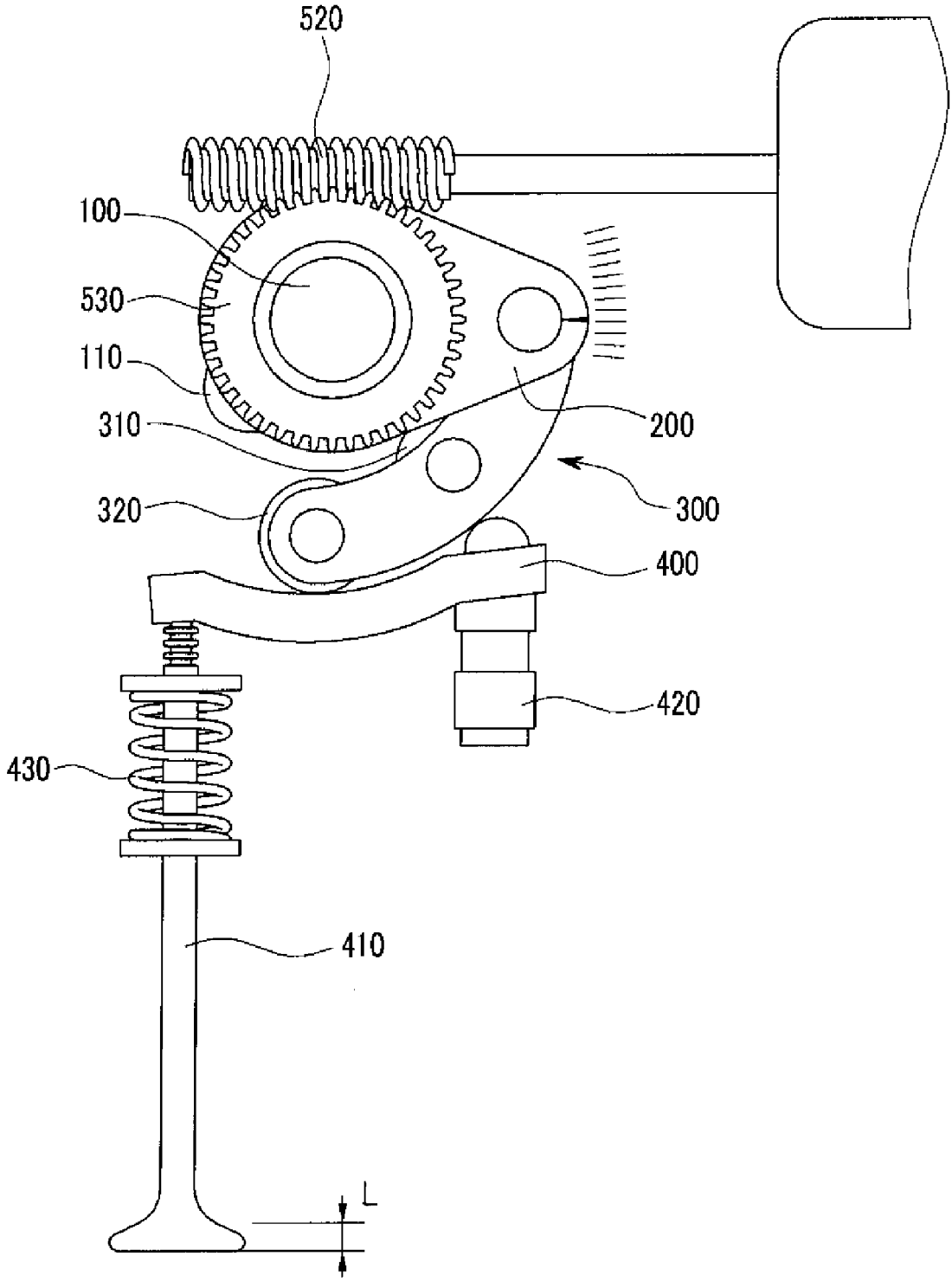
FIG. 7 is a drawing showing operation in low lift mode of an exemplary variable valve lift apparatus according to the present invention.
Figure 8:
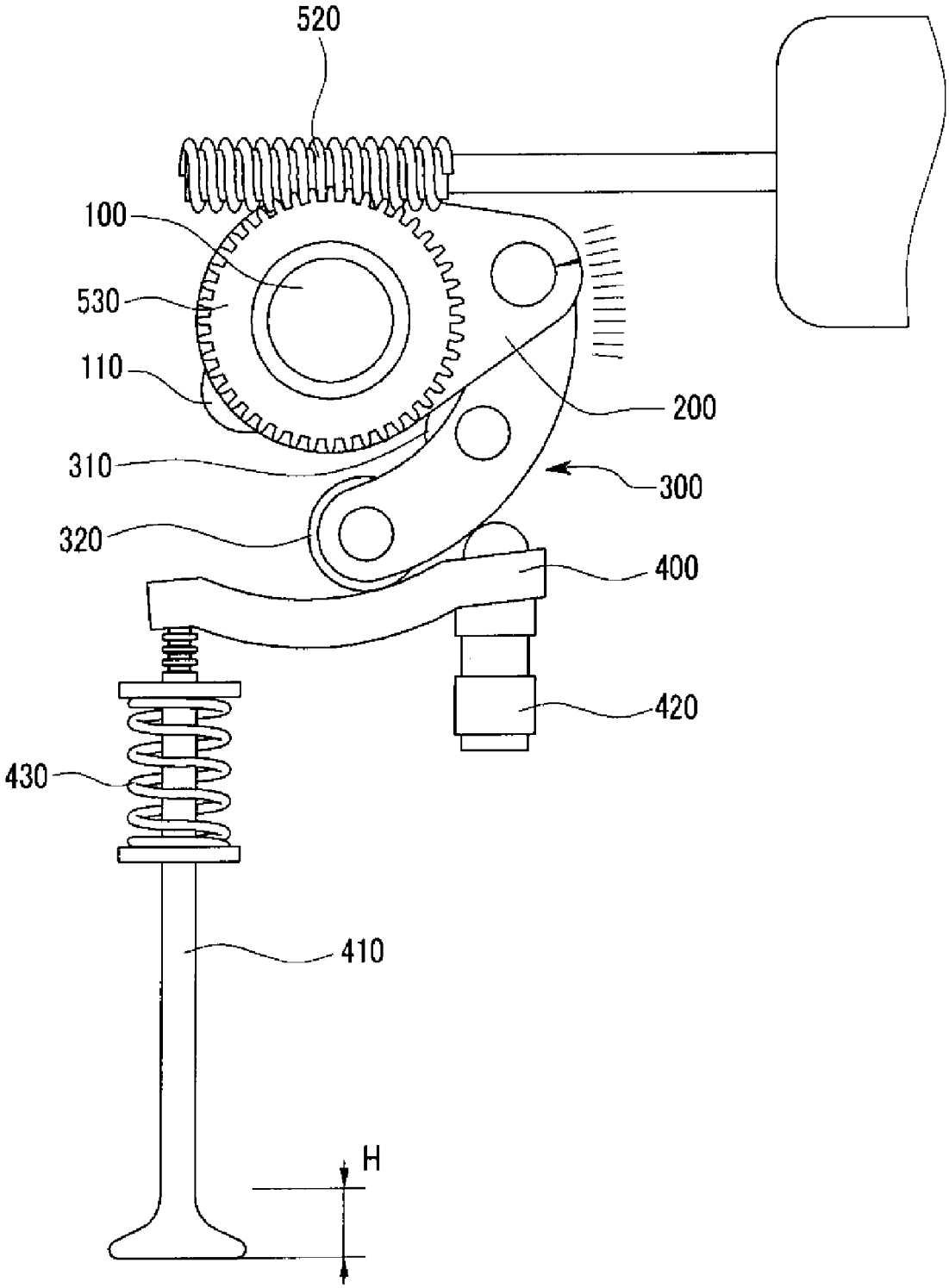
FIG. 8 is a drawing showing operation in high lift mode of an exemplary variable valve lift apparatus according to the present invention.

FIG. 7 and FIG. 8 are drawings respectively showing operations in low lift mode and in high lift mode of a variable valve lift apparatus according to various embodiments of the present invention.

Referring to FIG. 7 and FIG. 8, an operation of the variable valve lift apparatus according to various embodiments of the present invention will be explained.

In the low lift mode as illustrated in FIG. 7, the rocker arm 200 is turned in a relative clockwise direction around the camshaft 100.

Then, a contact position of the second roller 320 and the swing arm 400 is moved to the left in the drawings, that is, the contact poison becomes more distant from the HLA 420.

Then, the cam 110 rotates and pushes the first roller 310 of the cam follower 300, the cam follower 300 rotates counterclockwise around the connecting shaft 210 and pushes the swing arm 400, and the swing arm 400 pivots counterclockwise around the HLA 420 and opens the valve 410.

Then, the valve 410 is closed by restoring force of a valve spring 430.

In the low lift mode, the contact position of the second roller 320 and the swing arm 400 is more distant from a rotation center, i.e., HLA 420, of the swing arm 400, so the valve lift L is relatively small since the HLA 420 functions as leverage.

In contrast, in the high lift mode as illustrated in FIG. 8, the rocker arm 200 is turned in a relative anticlockwise direction around the camshaft 100.

Then, a contact position of the second roller 320 and the swing arm 400 is moved to the right in the drawings, that is, the contact poison becomes closer to the rotation center, i.e., the HLA 420.

Thus, in the high lift mode, the contact position of the second roller 320 and the swing arm 400 becomes closer to a rotation center of the swing arm 400, so the valve lift H is relatively large.

Figure 9A:
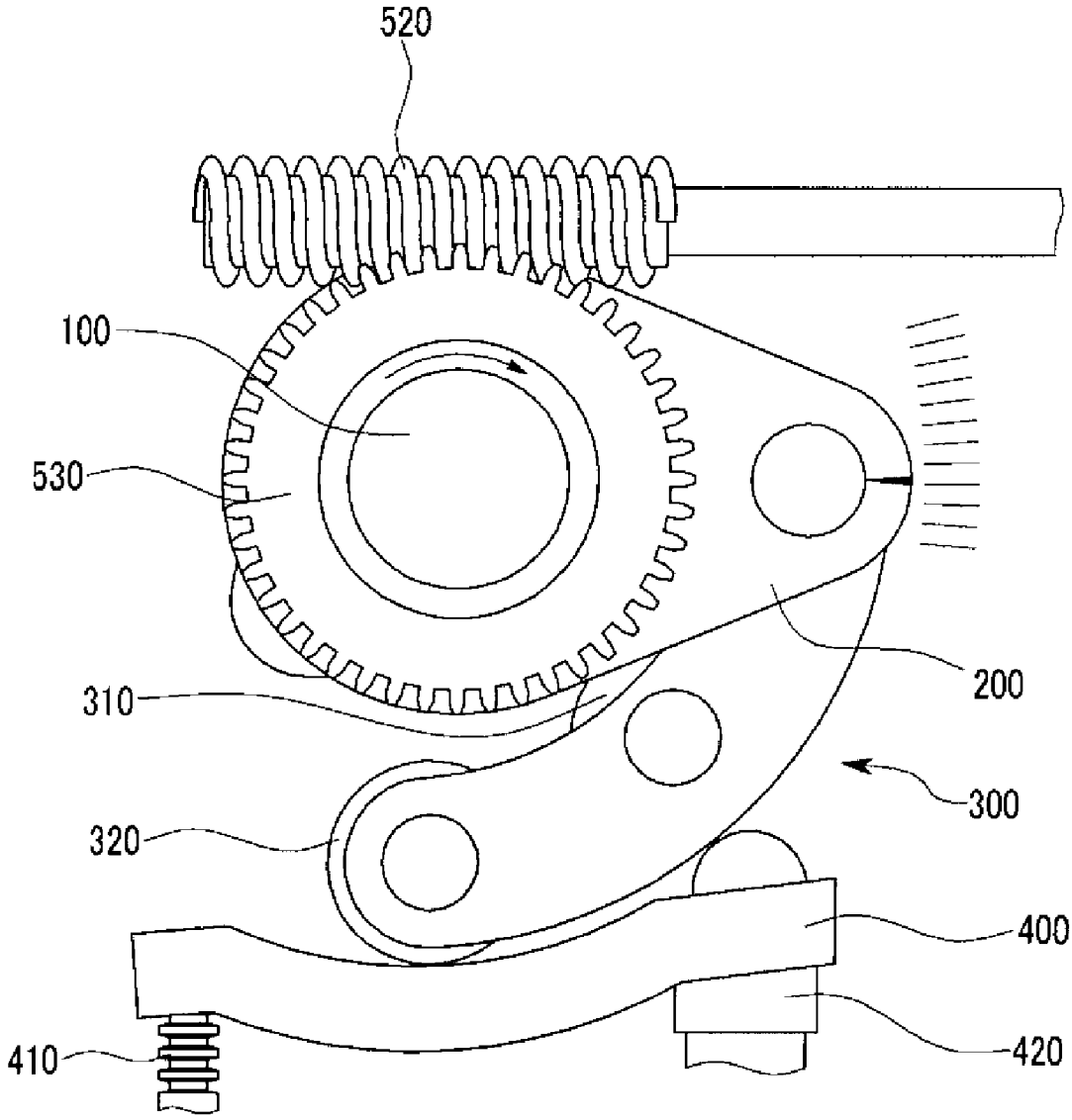
FIGS. 9A and 9B are drawings respectively showing operation and valve lift profile of an exemplary variable valve lift apparatus according to the present invention.
Figure 9B:
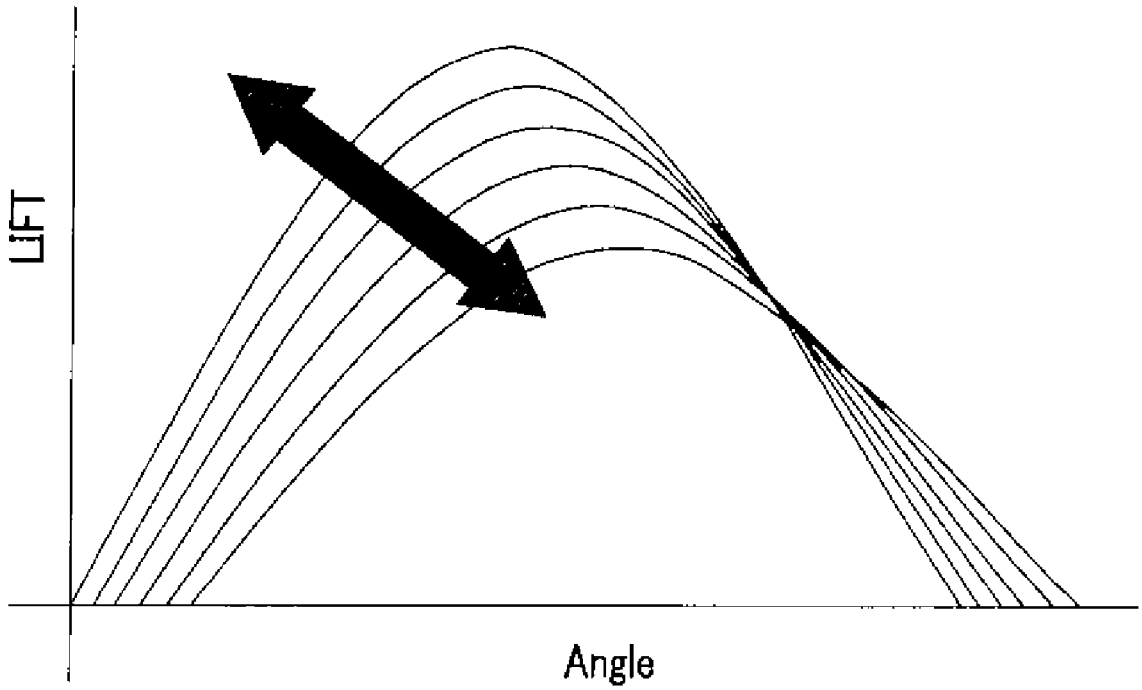
Figure 10A:
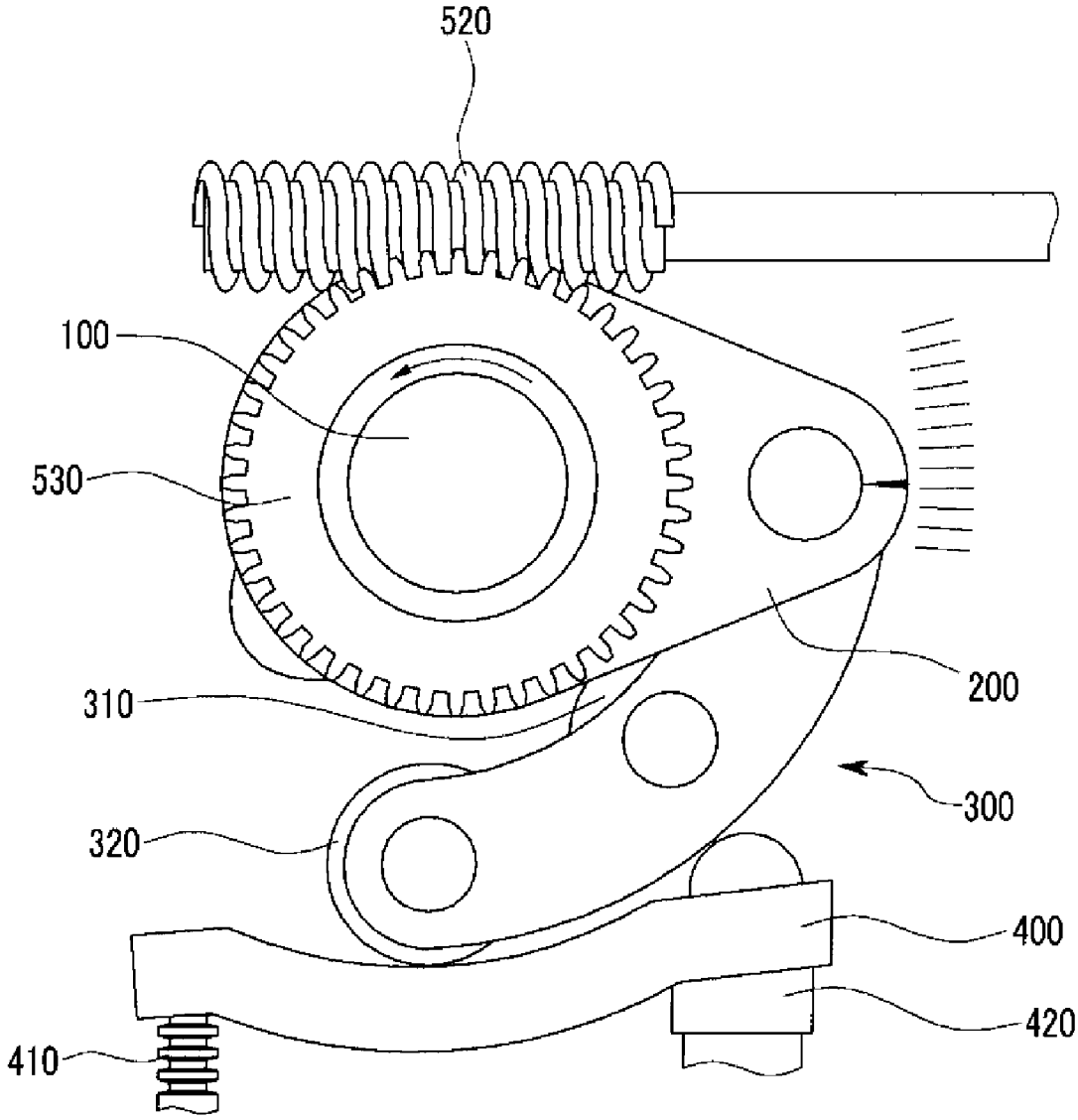
FIGS. 10A and 10B are drawings respectively showing operation and valve lift profile of an exemplary variable valve lift apparatus according to the present invention.

FIG. 9 and FIG. 10 explain an operation and valve lift profiles of the variable valve lift apparatus according to various embodiments of the present invention.

FIG. 9A is showing the variable valve lift apparatus according to various embodiments of the present invention in which a rotation direction of the camshaft 100 and that of the cam 110 is the same when it is changed to the low lift mode.

As shown in FIG. 9B, if a rotation direction of the camshaft 100 and that of the cam 110 is the same when it is changed to the low lift mode, lift timing is retarded, and on the other hand, if the variable valve lift apparatus according to various embodiments of the present invention is changed to the high lift mode, lift timing is advanced.

FIG. 10 shows the variable valve lift apparatus according to various embodiments of the present invention in which a rotation direction of the camshaft 100 and that of the cam 110 are opposite when it is changed to the low lift mode.

Figure 10B:
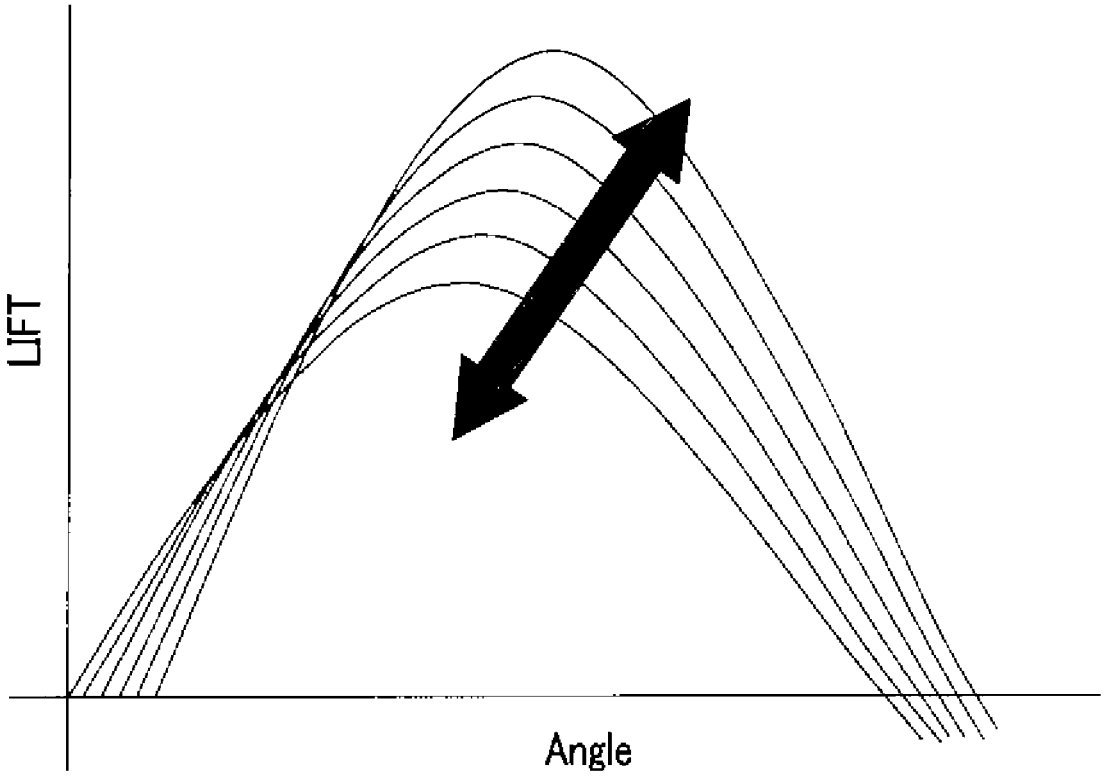

As shown in FIG. 10B, if a rotation direction of the camshaft 100 and that of the cam 110 are opposite when it is changed to the low lift mode, lift timing is advanced, and on the other hand, if the variable valve lift apparatus according to various embodiments of the present invention is changed to the high lift mode, lift timing is retarded.

Using the characteristics that lift timing is advanced or retarded, relative rotation direction of a camshaft may be selected according to required engine performance.

For convenience in explanation and accurate definition in the appended claims, the terms "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a cam that is co-axially attached to a camshaft and rotates by the camshaft;

a rocker arm, one end of which is rotatably coupled to the camshaft, wherein a relative rotation angle of the rocker arm around the camshaft is variable by an actuator;

a cam follower, one end of which is pivotally coupled to the other end of the rocker arm, wherein a contact portion of the cam follower contacts the cam and receives rotational movement of the cam; and a swing arm that contacts the other end of the cam follower and drives a valve coupled to one end of the swing arm according to rotation of the cam;

wherein the cam follower is disposed between the camshaft and the swing arm to transfer the rotational movement of the cam to the swing arm;

wherein a first roller is disposed to the contact portion of the cam follower and contacts the cam;

wherein a second roller is coupled to the other end of the cam follower and rotatably contacts the swing arm; and wherein the first roller is disposed between the second roller and the one end of the cam follower.

2. The variable valve lift apparatus of claim 1, wherein the swing arm has a predetermined curvature along a longitudinal direction thereof to receive the second roller of the cam follower.

3. The variable valve lift apparatus of claim 1, wherein the other end of the rocker arm and the one end of the cam follower are coupled by a connecting shaft and the cam follower pivots around the connecting shaft according to rotation of the rocker arm.

4. The variable valve lift apparatus of claim 1, wherein a rotation center of the swing arm is a portion that the other end of the swing arm and a hydraulic lash adjuster ("HLA") are coupled each other.

5. The variable valve lift apparatus of claim 1, wherein the actuator is electrically connected with a control unit that controls the relative rotation angle of the rocker arm around the camshaft.

6. The variable valve lift apparatus of claim 1, wherein the actuator comprises a DC motor.

7. The variable valve lift apparatus of claim 6, wherein the actuator comprises a worm gear connected with the DC motor and a worm wheel attached to the one end of the rocker arm, wherein the worm gear and the worm wheel are engaged each other.

8. An engine comprising the variable valve lift apparatus of claim 1.

9. A passenger vehicle comprising the variable valve lift apparatus of claim 1.

* * * * *